US005810237A

United States Patent [19]

Eskola et al.

[11] Patent Number: 5,810,237

[45] Date of Patent: Sep. 22, 1998

[54] DRIVE ASSEMBLY FOR A WEB SPREADING ROLL

[75] Inventors: Timo Eskola, Järvenpää ; Leo Kurkinen, Helsinki, both of Finland

[73] Assignee: Valmet Corporation, Helsinki, Finland

[21] Appl. No.: 834,081

[22] Filed: Apr. 14, 1997

Related U.S. Application Data

[63] Continuation of Ser. No. 433,698, May 3, 1995, abandoned.

[30] Foreign Application Priority Data

May 3, 1994 [FI] Finland ..... 942025

[51] Int. Cl.[6] ..... B65H 20/00; F16H 7/00; F16G 1/28

[52] U.S. Cl. ..... 226/188; 226/194; 474/85; 474/205

[58] Field of Search ..... 226/188, 190, 226/194; 464/79, 80; 26/51.3, 51.4, 99, 100, 101, 102; 474/148, 150, 205, 85

[56] References Cited

U.S. PATENT DOCUMENTS

| | | | |
|---|---|---|---|
| 3,401,541 | 9/1968 | Stevens, Jr. et al. | 226/194 |
| 4,138,901 | 2/1979 | Fortin et al. | 474/150 |
| 4,420,109 | 12/1983 | Zahn et al. | 226/188 |
| 5,415,592 | 5/1995 | Hoyt | 474/85 |

FOREIGN PATENT DOCUMENTS

| | | | |
|---|---|---|---|
| 0248403 | 8/1987 | Germany | 464/79 |
| 6257645 | 9/1994 | Japan | 474/205 |
| 1097329 | 1/1968 | United Kingdom | 474/85 |

OTHER PUBLICATIONS

Brochure issued by IRGA S.p.A.—Cylindres Elargisseurs Cintres.

*Primary Examiner*—Charles A. Marmor
*Assistant Examiner*—Matthew A. Kaness
*Attorney, Agent, or Firm*—Cohen, Pontani, Lieberman & Pavane

[57] ABSTRACT

A drive assembly for operatively rotating a web spreading roll of a paper mill or the like utilizes a toothed belt for transferring rotational motion from a motor-operated driving toothed pulley to a freewheeling or otherwise rotatably mounted driven toothed pulley. The driven pulley is, in turn, coupled to at least one of the plural rotary driven roll segments of and that are carried on the curved shaft of the web spreading roll. To minimize wear on the toothed belt, the driving and driven pulleys are fixedly mounted in positions of permanent alignment with one another, as by mounting both the drive motor and the driven pulley on the shaft bearings housing located at one end of the spreading roll shaft. A flexible coupling, as in the form of a rubber or otherwise suitably resilient bellows or the like, connects the driven pulley to the at least one roll segment for transferring rotation of the driven pulley to the roll segment so as to operatively rotate the web spreading roll.

6 Claims, 1 Drawing Sheet

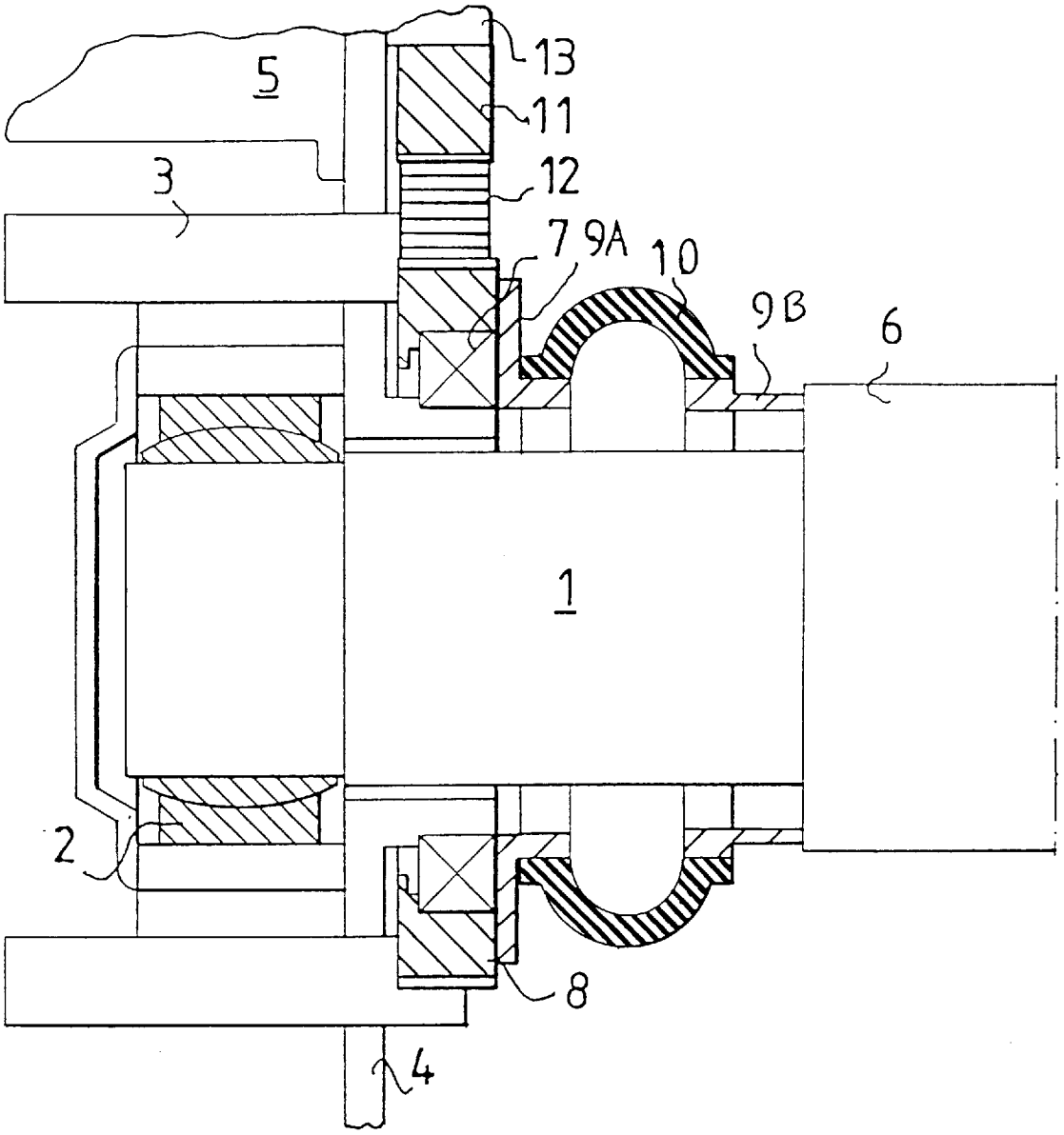
13
5
11
12
3
7
9A
10
9B
6
1
2
8
4

DRIVE ASSEMBLY FOR A WEB SPREADING ROLL

This is a continuation of application Ser. No. 08/433,698, filed May 3, 1995 now abandoned.

FIELD OF THE INVENTION

The present invention is directed to apparatus for driving the spreading roll in an apparatus of environment in which a moving web is advanced over the spreading roll.

BACKGROUND OF THE INVENTION

Spreading rolls are commonly used, by way of typical example, in conjunction with finishing equipment or devices in paper mills to maintain a sufficient and substantially constant tension transversely across the web—i.e. in the so-called cross-machine direction—as the web runs or travels or advances over the guide rolls. Spreading is needed because of variations in web width resulting from the coating, drying and calendering steps or processes. In addition, the longitudinal (i.e. the travel or machine direction) tension of the running web tends to cause at least slight centripetal contraction of the web toward its center.

A spreading roll generally comprises a curved shaft having its radius of curvature vector aligned in the machine direction and a plurality of rotary driven roll segments mounted in bearings on and along the shaft. The roll segments are coupled to one another and are driven for rotation about the shaft by a synchronous belt drive. The belt drive assembly is implemented by a toothed pulley coupled to the outermost rotary roll segment of the spreading roll, a drive motor, a toothed pulley mounted on the drive shaft of the motor, and a toothed belt operatively connecting the two toothed pulleys. The pulley coupled to and driving the roll segments is mounted in bearings on the curved shaft and is connected to the outermost roll segment by a nonflexible coupling. The drive motor is mounted, by way of example, on the bearing housing of the end bearing of the curved spreading roll shaft.

As the web passes over the spreading roll, each roll segment imposes on the web a force of a magnitude dependent on its orientation relative to the web and directed transversely outward, i.e. toward the outer or side edges of the web, thus tensioning the web in the cross-machine direction. The rotational speed of the spreading roll must be precisely controlled to accord with the web speed so as to avoid overtensioning of the web and to achieve the desired web tensioning in the cross-machine direction. By virtue of this strict requirement for accuracy in spreading roll rotational speed, a toothed belt must be employed for driving the spreading roll. A V-belt cannot be used because the slippage inherent in the use of such belts makes it virtually impossible to assure accurate speed control. The use of a roller chain drive is similarly unsatisfactory due to the typical pulsating speed variations, an effect which cannot be tolerated in applications of this type. Slip-free and highly accurate rotational speed control of a spreading roll is, on the other hand, readily achievable using a toothed belt.

A major shortcoming of synchronous belt drives that are currently used for driving a web spreading roll is the heretofore unavoidable nonalignment of the driven toothed pulley that is mounted on the end of the curved roll shaft relative to the driving toothed pulley mounted on the end of the drive motor shaft. The driven pulley is located inherently parallel to the edge of the outermost roll segment and is conventionally coupled to the outermost roll segment in a fixed manner. The driving pulley of the drive motor is difficult to align with the driven pulley and, in practice, there remains between the two pulleys an angular misalignment that causes rapid wearing and a resultant drastic shortening of the useful life of the toothed belt that connects the driving and driven pulleys. The orientation of the driven pulley will unavoidably change with the radius of curvature adjustment of the spreading roll shaft, thus necessitating that the drive motor be mounted on an adjustable base or support permitting alignment or realignment with the drive assembly pulleys. This required alignment facility and procedure notably complicates the construction of the drive assembly and increases the labor involved in adjusting the radius of curvature of the spreading roll.

OBJECT AND SUMMARY OF THE INVENTION

It is accordingly an object of the present invention to provide a synchronous belt drive assembly for a running web spreading roll that is free of angular nonalignment between the driving and driven toothed pulleys.

Briefly described, this object is achieved in accordance with a currently preferred, and herein described, embodiment of the invention by mounting the driven toothed pulley, in a fixed position of alignment with the driving pulley, in bearings carried on the bearing housing of the curved spreading roll shaft, and coupling the driven pulley with the outermost roll segment of the spreading roll by way of a flexible coupling. This arrangement provides significant structural and operating benefits not heretofore attainable or realized.

The principal benefits of the present invention include a simplified construction of the drive assembly for a spreading roll, and the elimination of angular nonalignment between the toothed driving and driven pulleys. The driven pulley which effects rotation of the roll segments may be mounted in bearings in a fixed position or location relative to the driving pulley, whereby its alignment will not change and or require user adjustment during a radius of curvature adjustment of the curved spreading roll. The drive motor may therefore be correspondingly mounted on a fixed base or support, so that all requirements for adjustment are reduced to belt tension adjustments alone. Since the drive motor does not require realignment during a radius of curvature adjustment of the spreading roll, the latter procedure may be completed significantly faster and more easily. Moreover, the permanent elimination of angular nonalignment between the driven and driving pulleys results in decreased wear of the belt and a substantial increase in its useful life. When desired, the inventive assembly may also be readily modified as a general matter of design choice to utilize or accomodate multiple parallel belts and pulleys.

Other objects and features of the present invention will become apparent from the following detailed description considered in conjunction with the accompanying drawing. It is to be understood, however, that the drawing is designed solely for purposes of illustration and not as a definition of the limits of the invention, for which reference should be made to the appended claims. It should be further understood that the drawing is not necessarily drawn to scale and that, unless otherwise indicated, it is merely intended to conceptually illustrate the structures and procedures described herein.

BRIEF DESCRIPTION OF THE DRAWING

The single drawing FIGURE is a cross-sectional view, partly broken away, of a drive assembly for a web spreading roll constructed in accordance with the teachings of the present invention.

DETAILED DESCRIPTION OF THE PREFERRED EMBODIMENT

With specific reference now to the drawing FIGURE, a curved shaft 1 of an operatively rotatable spreading roll is seen mounted at its ends—only one end being shown, the other end being identical but a mirror image—in bearings by means of a ball-and-socket bearing 2 that is supported by or contained within a bearing housing 3. As is well known, the shaft 1 carries thereon and therealong a plurality of spreading roll segments, only the outermost one 6 of which is visible in the FIGURE. The bearing housing 3 includes a mounting flange 4 on which are mounted an operable drive motor 5 having a rotatable shaft 13 and a driven toothed pulley 8. The pulley 8 is mounted for rotation on the flange 4 in a bearing 7. A driving toothed pulley 11 is carried on the shaft 13 of the drive motor 5 for rotation of the pulley with the shaft when the motor is operated. A continuous toothed pulley belt 12 spanningly encircles and couples the driven and driving pulleys 8, 11 to one another, so that motor-driven rotation of the driving pulley 11 is transferred to and effects concurrent rotation of the driven pulley 8.

The driven pulley 8 is coupled to the outermost roll segment 6 of the curved spreading roll by a flexible coupling. As depicted in the FIGURE, the flexible coupling is formed by opposed or spaced apart mounting flanges 9A, 9B respectively secured to or carried by the driven pulley 8 and the roll segment 6, and a flexible bellows 10 that joins or connects the opposed mounting flanges. The bellows 10 may be formed of any suitably resilient and flexible material such, for example, as rubber.

The inventive arrangement accordingly permits permanent mounting of the driven pulley 8 and, furthermore, accurate alignment—which is continuously, automatically, dynamically adjusted or accommodated through resilient flexing of the flexible coupling—of the driven pulley with the motor-driven driving pulley 11. The importance of these features in realizing highly reliable operation and functionality in a synchronous belt drive assembly cannot be overemphasized. The flexible coupling—herein implemented, by way of currently preferred example, by the opposed mounting flanges 9A, 9B and the flexible bellows 10 connecting the flanges—is able to transmit the driving torque from the driven pulley 8 to the roll segment 6 notwithstanding a possible angular nonalignment of or between these two coupled elements. Moreover, any change in such angular alignment, or nonalignment, during a radius of curvature adjustment of the spreading roll likewise has no effect, by virtue of the flexible coupling, on the functioning of the drive assembly.

Those skilled in the art will readily appreciate and recognize that the inventive arrangement and apparatus, as herein disclosed, may be selectively modified in numerous ways as general matters of design choice and/or otherwise to accommodate specific applications and environments, and all such modifications are within the intended scope and contemplation of the invention. For example, the structure of or elements forming the flexible coupling—herein described as a bellows 10 connecting opposed mounting flanges 9A, 9B—may be modified as necessary or desired, and numerous types of flexible couplings which are known and/or otherwise commercially available may be employed or applied as herein taught in lieu of the particular arrangement shown in the FIGURE. Similarly, the manner and location of mounting the driven toothed pulley and the drive motor on the roll shaft bearing housing may be implemented in any desired arrangement and, indeed, the design of the drive assembly should in any event be tailored or fit to the design of the spreading roll and in accordance with space constraints. The number of pulleys and belts may also be varied to accommodate the amount of power to be transmitted thereby in the particular application.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A drive assembly in combination with a web spreading roll, the roll including a curved shaft rotatably supported at its ends and a plurality of rotary driven roll segments carried on the shaft, comprising:

a frame;

an operable drive motor having a shaft that is rotated when said motor is operated, said drive motor being mounted to the frame;

a driving toothed pulley mounted to said shaft for rotation with said shaft when said motor is operated;

a bearing rotatably mounted onto said frame;

a driven toothed pulley rotatably mounted to said frame in a fixed position on said frame for rotation on said bearing so that said driven pulley rotates on said frame in a continuous fixed alignment relative to said frame, an axis of said driven pulley being positionally and angularly fixed in continuous alignment with an axis of said driving toothed pulley so that said driven and driving pulleys are in continuous positional and angular alignment with one another during their rotation;

a toothed belt coupling said driving toothed pulley to said driven toothed pulley so that motor shaft-driven rotation of said driving pulley is transferred through said toothed belt to said driven pulley to rotate said driven pulley; and a flexible coupling connecting said driven pulley to at least one of the plural roll segments for communicating said rotation of said driven pulley to the at least one roll segment so as to effect rotation of the at least one roll segment, and for flexibly accommodating changes in the position of the at least one roll segment relative to said driving pulley and permitting maintenance of said continuous alignment of said driving and driven pulleys.

2. The apparatus of claim 1, wherein said flexible coupling comprises a flexible bellows connected between said driven pulley and said at least one roll segment.

3. The apparatus of claim 1, wherein said flexible coupling comprises a first mounting flange connected to said driven pulley, a second mounting flange connected to said at least one roll segment, and a flexible bellows connected between said first and second mounting flanges.

4. In an assembly for rotatably driving at least one roll segment carried on a curved shaft of a web spreading roll, the shaft being rotatably supported at its ends, and including a drive motor mounted in a frame and operable for rotating a driving toothed pulley, a rotatable driven toothed pulley coupled to the at least one roll segment, and a toothed belt coupling the driving and driven pulleys for effecting rotation of said driven pulley when said driving pulley is rotated by said drive motor to thereby rotate the at least one roll segment, the improvement comprising:

a bearing rotatably mounted onto the frame;

an axis of said driving pulley and an axis of said driven pulley being fixedly mounted in positions of permanent positional and angular alignment relative to one another so that said driven and driving pulleys are in continuous positional and angular alignment with one another during their rotation; and said driven pulley being rotatably mounted to said frame in a fixed postion on said frame on said bearing so that said driven pulley rotates on said frame in a continuous fixed alignment relative to said frame, said driven pulley being coupled to the at least one roll segment by a flexible coupling through which rotation of said driven pulley is communicated to and effects rotation of the at least one roll segment and for flexibly accommodating changes in the relative positions of said at least one roll segment and said driven pulley so as to permit said permanent relative alignment of said driving and driven pulleys.

5. The apparatus of claim 4, said flexible coupling comprising a flexible bellows connected between said driven pulley and said at least one roll segment.

6. The apparatus of claim 4, said flexible coupling comprising a first mounting flange connected to said driven pulley, a second mounting flange connected to said at least one roll segment, and a flexible bellows connected between said first and second mounting flanges.

* * * * *